United States Patent [19]

Johnson

[11] Patent Number: 4,623,891

[45] Date of Patent: Nov. 18, 1986

[54] FAR-FIELD NULLING TECHNIQUE FOR REDUCING THE SUSCEPTIBILITY TO CROSS-POLARIZED SIGNAL IN DUAL-POLARIZED MONOPULSE-TYPE TRACKING ANTENNAS

[75] Inventor: Richard C. Johnson, Atlanta, Ga.

[73] Assignee: The United States of America as represented by the Secretary of the Army, Washington, D.C.

[21] Appl. No.: 620,973

[22] Filed: Jun. 15, 1984

[51] Int. Cl.[4] ..... H01Q 21/06; H01Q 21/24

[52] U.S. Cl. ..... 342/361; 343/778; 333/156; 342/427

[58] Field of Search ..... 343/853, 778, 361, 427; 333/111, 156

[56] References Cited

U.S. PATENT DOCUMENTS

| | | | |
|---|---|---|---|
| 3,028,591 | 4/1962 | Hattingly | 343/853 |
| 3,308,468 | 3/1967 | Hannan | 343/853 |
| 3,618,092 | 11/1971 | Waineo | 343/853 |
| 4,198,641 | 4/1980 | Gibson | 343/853 |

*Primary Examiner*—Eli Lieberman

*Attorney, Agent, or Firm*—Saul Elbaum; Thomas E. McDonald; Anthony T. Lane

[57] ABSTRACT

A technique for reducing cross-polarized signals in the axis of four-port dual-polarized antennas. The resulting lower cross-polarized signals reduce a tracking antenna's susceptibility to tracking errors and to breaklocks. Some energy from the transmission line connected to the (V) port is coupled, after proper attenuation and phase adjustment, and transmitted through the (H) port, thereby nulling out the (V) cross-polarized pattern.

8 Claims, 9 Drawing Figures

FAR-FIELD NULLING TECHNIQUE FOR REDUCING THE SUSCEPTIBILITY TO CROSS-POLARIZED SIGNAL IN DUAL-POLARIZED MONOPULSE-TYPE TRACKING ANTENNAS

RIGHTS OF THE GOVERNMENT

The invention described herein may be manufactured, used, and licensed by or for the U.S. Government for Governmental purposes without the payment of royalty to me of any royalty thereon.

BACKGROUND OF THE INVENTION

The present invention relates to dual-polarized tracking antennas, and more particularly to reducing cross-polarized signals in the vicinity of such antennas.

Dual-polarized tracking antennas have four difference ports (Δ)-one pair for each polarization. FIG. 1 illustrates in schematic form a dual-polarized monopulsetype tracking antenna in which the polarizations are horizontal (H) and vertical (V). While any pair of orthogonal polarization may be used, the six ports in this example are:

Σ(H)-sum (horizontally Polarized)
$\Delta_a$(H)-azimuth difference (horizontally polarized)
$\Delta_a$(H)-elevation difference (horizontally polarized)
Σ(V)-sum (vertically polarized)
$\Delta_a$(V)-azimuth difference (vertically polarized)
$\Delta_e$(V)-elevation difference (vertically polarized)

When a single polarization is used, a set of three ports is chosen, either the horizontal or vertical.

Radiation patterns when these ports are energized, if, for example, the polarizations are horizontal and vertical, are illustrated in FIGS. 2(*a*)–2(*d*). The solid patterns represent the desired co-polarized radiation and the dashed patterns represent the undesired cross-polarized radiation. The cross-polarized lobes usually are about 10dB to 20dB lower than the co-polarized lobes for a conventional antenna. The cross-polarization results in the antenna's susceptibility to tracking errors and to breaklocks.

Prior art techniques to reduce the cross-polarized radiation in the vicinity of the axis of a dual-polarized tracking antenna involved choosing antenna and feed geometries, but satisfactory performance could not always be achieved and some degradation of performance had to be accepted. Nulling techniques for communication systems use a single dual-polarized antenna beam to achieve their nulls and hence they are effective over only a narrow angular region of the beam and these techniques are not applicable to cross-polarization in the difference patterns of tracking antennas.

Variable-ratio microwave power dividers, utilizing two spaced-apart 90 degree hybrids directionally coupling two microwave channels and an adjustible phase shifting device disposed between the two 90 degree hybrids, have been known in the art for many years. For example, such a variable power divider is described in a paper entitled "A Variable-ratio Microwave Power Divider and Multiplexer", by W. L. Teeter and K. R. Bushore, IRE Transactions on Microwave Theory and Techniques, October, 1957, pages 227–229. In this power divider, an incoming microwave signal may be directed solely to either of two outputs or may be divided in any disired ratio between the two outputs by adjustment of the phase shifting device.

OBJECTS OF THE INVENTION

It is therefore an object of the present invention to reduce cross-polarized signals in the vicinity of the axis of dual-polarized tracking antennas.

Another object of the present invention is to reduce tracking errors and breaklocks in tracking antennas.

Still another object of the present invention is to provide a technique to reduce cross-polarization in the difference patterns of tracking antennas.

These and other objects of the present invention are provided by applying energy from the cross-polarized orthogonal-axis difference pattern to reduce crosspolarized signals in the desired difference pattern over a relatively large angular region around the tracking axis. Directional couplers are provided between the difference patterns and the signals appropriately phase shifted.

Other objects and further aspects of the present invention will become apparent during the course of the following description and by reference to the accompanying drawings wherein like numerals represent like parts throughout the several views, wherein

DESCRIPTION OF THE PREFERRED EMBODIMENT

To understand how the nulling technique works, suppose that the transmitted signal is on the vertically polarized radiation through the $\Delta_e$(V) port. It is desired to transmit only on the co-polarized pattern (solid in FIG. 2(*b*)), and not on the cross-polarized pattern (dashed in FIG. 2 (*b*)).

The co-polarized pattern of the $\Delta_a$(H) port is the same as the cross-polarized pattern of the $\Delta_e$(V) port. If some energy from the transmission line connected to the $\Delta_e$(V) port, properly adjusted for amplitude and phase, is transmitted through the $\Delta_a$(H) port, the cross-polarized pattern of $\Delta_e$(V) can be nulled out. In actual practice, not all of the $\Delta_e$(V) cross-polarized pattern can be nulled out everywhere, because the two patterns under consideration are not identical. However, the cross-polarized pattern in the region of interest, namely around the tracking axis, is thoroughly nulled out. Thus, if one desires to receive on a vertically polarized elevation difference pattern, he would use signals from the horizontally polarized azimuth difference pattern to destructively interfere with the cross-polarized signals in the desired pattern.

Figure 1:
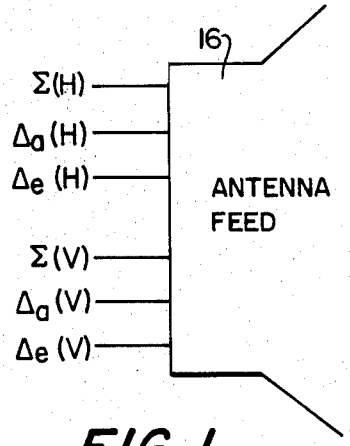
FIG. 1 is a schematic diagram of a dual-polarized monopulse-type tracking antenna and the six ports feeding the antenna.
Figure 2A:
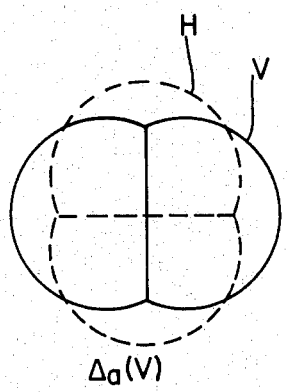
FIGS. 2(*a*)–2(*d*) illustrate in schematic form the far-field patterns from the four difference (Δ) ports as viewed along the (Σ) sum beam axis.
Figure 2B:
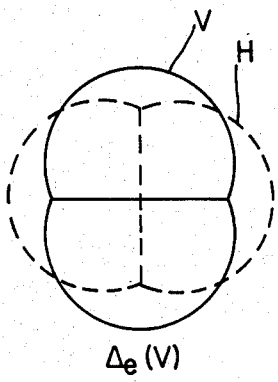
Figure 2C:
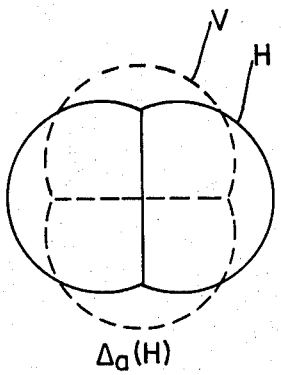
Figure 2D:
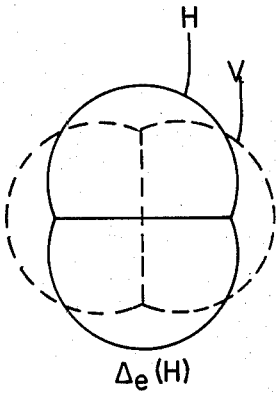
Figure 3:
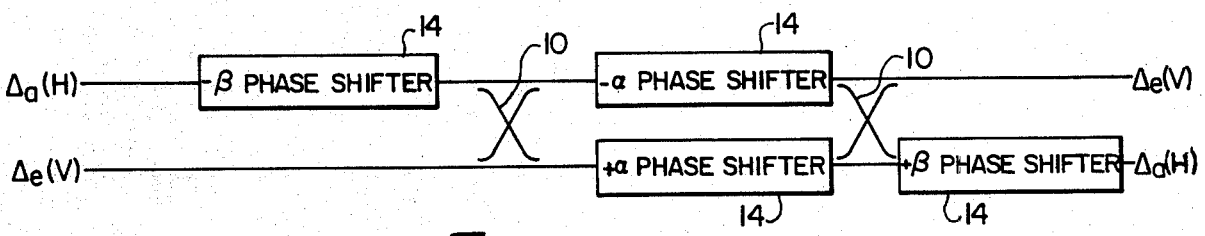
FIG. 3 is a schematic diagram of the nulling circuit according to one embodiment of this invention.

Referring now to FIG. 3, there is illustrated a schematic diagram of the nulling circuit with the $\Delta_e$(V) and $\Delta_a$(H) ports coupled.

A coupling circuit disposed in the $\Delta_e(V)$ and $\Delta_a(H)$ transmission lines includes two spaced-apart 90 degree hybrid directional couplers 10 and two phase shifters 14 respectively disposed in the two transmission lines between the two 90 degree hybrids 10. The two phase shifters 14 of the coupling circuit have settings of $-\alpha$ and $+\alpha$, respectively. FIG. 3 also includes two additional phase shifters 14, one disposed in the $\Delta_a(H)$ transmission line ahead of the coupling circuit and having a setting of $-\beta$, and the other disposed in the $\Delta_a(H)$ transmission line behind the coupling circuit and having a setting of $+\beta$. In practice, $\alpha$ determines the magnitude of the coupling, and $\beta$ determines the relative phase between the $\Delta_e(V)$ and $\Delta_a(H)$ ports. The circuit of FIG. 3 is designed so that the main signal phase shift is a constant value, independent of the $\alpha$ and $\beta$ settings.

Figure 4:
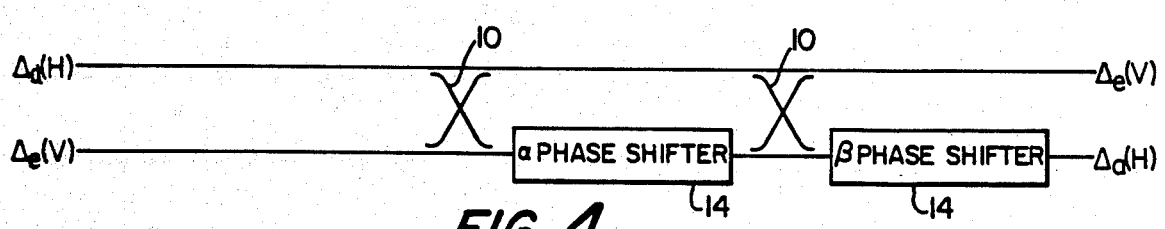
FIGS. 4 and 5 are schematic diagrams of nulling circuits according to two other embodiments of this invention.

The embodiment of FIG. 4 can be used when a constant phase shift is not required in the main channels. FIG. 4 includes a coupling circuit disposed in the $\Delta_e(V)$ and $\Delta_a(H)$ transmission lines which consists of two spaced-apart 90 degree hybid directional couplers 10 and an $\alpha$ phase shifter 14 disposed in one of the transmission lines between the two 90 degree hybrids 10. FIG. 4 also includes a $\beta$ phase shifter 14 disposed in the $\Delta_a(H)$ line after the coupling circuit.

Figure 5:
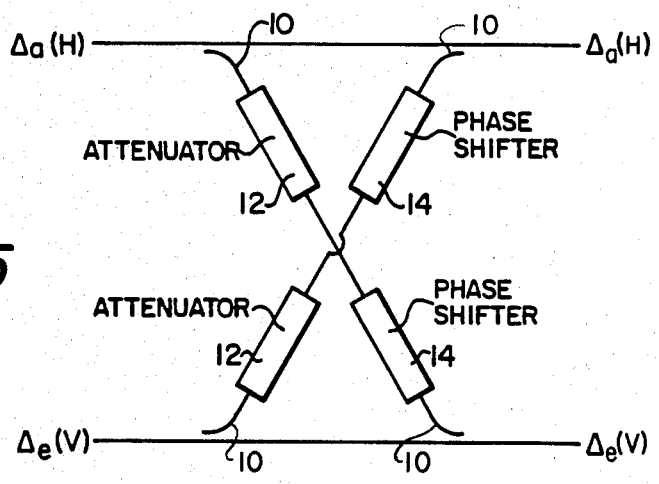

The embodiment of FIG. 5, which can be used when insertion loss is not critical, includes four 90 degree hybrid directional couplers 10, two attenuators 12, and two phase shifters 14. FIG. 5 includes two coupling circuits for directionally coupling the two transmission lines $\Delta_e(V)$ and $\Delta_a(H)$ in respective opposite directions. Each coupling circuit includes a 90 degree hybrid 10 coupled to the $\Delta_e(V)$ line which is connected in series through an attenuator 12 and phase shifter 14 to a 90 degree hybrid coupled to the $\Delta_a(H)$ line.

Figure 6:
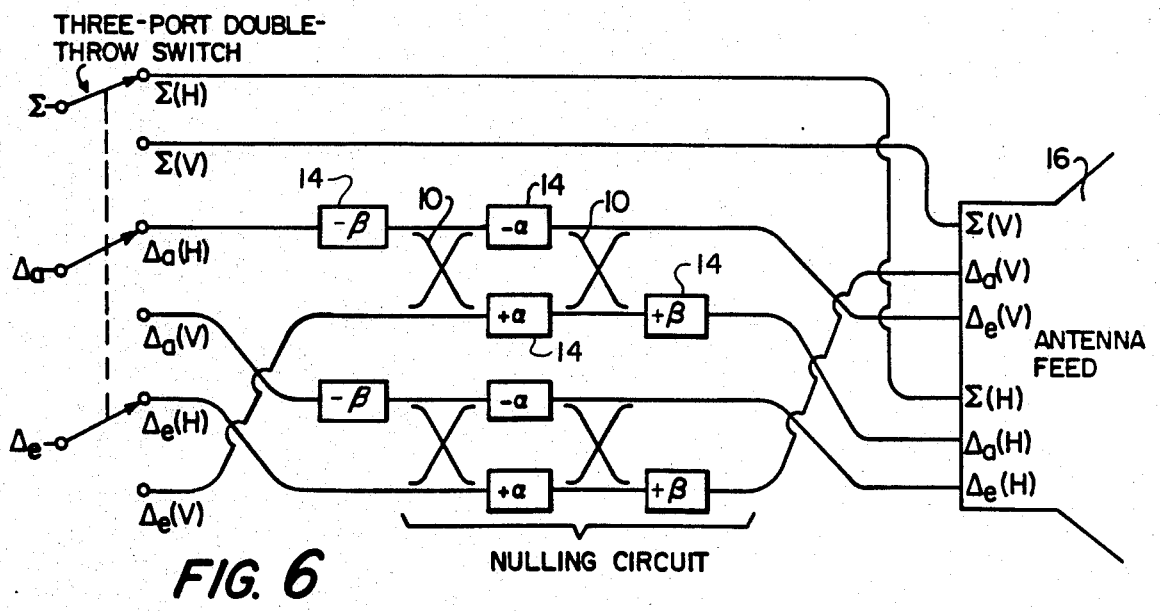
FIG. 6 is a schematic diagram illustrating the nulling circuit of FIG. 3 in a dual-polarized monopulse-type tracking antenna.

When the nulling circuit of FIG. 3, 4, or 5 is used in a dual-polarized monopulse-type tracking antenna, the ports are coupled as pairs, $\Delta_e(V)$ with $\Delta_a(H)$, and $\Delta_e(H)$ with $\Delta_a(V)$, as shown in FIG. 6 which utilizes two of the nulling circuits of FIG. 3.

Typical elements for the various embodiments described herein that may be employed as follows:

Attentuator 12— Hewlett Packard Model G382A

Phase Shifter 14— ARRA Inc., Bayshore, N.Y. Model No. 9428A-28

Directional Coupler 10—ARRA Model No. 5164-90

There has therefore been described a technique for greatly reducing cross-polarized radiation in the vicinity of the axis of a dual-polarized tracking antenna. This greatly reduces or eliminates tracking errors and breaklocks due to cross-polarized signals.

It is to be understood that the above embodiments are simply illustrative of the invention. Various other modifications and changes may be made by those skilled in the art which will employ the principles of the invention and fall within the spirit and scope thereof.

I claim:

1. Apparatus for reducing cross-polarized radiation in the vicinity of the axis of a dual-polarized monopulse-type tracking antenna having four difference ports connected to respective signal channels, namely, a horizontally polarized azimuth difference first port and channel, a horizontally polarized elevation difference second port and channel, a vertically polarized azimuth difference third port and channel, and a vertically polarized elevation difference fourth port and channel, wherein said apparatus comprises:

first directional coupling means, connected to the first and fourth channels, for directionally diverting a portion of a first signal in either channel to the other channel, said first directional coupling means including first magnitude adjusting means for adjusting the magnitude of the diverted portion of the first signal relative to the magnitude of the undiverted portion of the first signal;

first phase shifting means for shifting the phase of the diverted portion of the first signal relative to the phase of the undiverted portion of the first signal;

second directional coupling means, connected to the second and third channels, for directionally diverting a portion of a second signal in either channel to the other channel, said second directional coupling means including second magnitude adjusting means for adjusting the magnitude of the diverted portion of the second signal relative to the magnitude of the undiverted portion of the second signal; and second phase shifting means for shifting the phase of the diverted portion of the second signal relative to the phase of the undiverted portion of the second signal.

2. Apparatus, as described in claim 1, wherein the first and second directional coupling means each comprises:

a third phase shifting means disposed in one of the two channels associated with the directional coupling means; and two 90 degree hybrids connected between the two channels on opposite ends of the third phase shifting means.

3. Apparatus, as described in claim 2, wherein the first and second phase shifting means each comprises a phase shifter disposed in one of the two associated channels.

4. Apparatus, as described in claim 1, wherein the first and second directional coupling means each comprises:

third and fourth phase shifting means disposed respectively in the two channels associated with the directional coupling means; and two 90 degree hybrids connected between the two channels on opposite ends of the third and fourth phase shifting means.

5. Apparatus, as described in claim 4, wherein the first and second phase shifting means each comprises two phase shifters disposed in one of the associated channels at opposite ends of the associated directional coupling means.

6. Apparatus, as described in claim 1, wherein the combination of the first directional coupling means and the first phase shifting means associated with the first and fourth channels and the combination of the second directional coupling means and second phase shifting means associated with the second and third channels each comprises:

a first circuit for diverting a portion of a signal flowing in one direction in one of the two associated channels to the other channel in the same one direction, and for diverting a portion of a signal flowing in an opposite direction in the other channel to the one channel in the same opposite direction, said first circuit comprising a first attenuator, a first phase shifter connected in series with the first attenuator, a first directional coupler to the one channel and connected in series with the first attenuator and first phase shifter, and a second directional coupler coupled to the other channel and connected in series with the first phase shifter and first attenuator; and a second circuit for diverting a portion of a signal flowing in said opposite direction in said one channel to the other channel in the same opposite direction, and for diverting a portion of a signal flowing in said one direciton in the other channel to the one channel in the same one direction, said second circuit comprising a second attenuator, a second phase shifter connected in series with the second attenuator, a third directional coupler coupled to the one channel and connected in series with the second attenuator and second phase shifter, and a fourth directional coupler coupled to the other channel and connected in series with the second phase shifter and second attenuator.

7. Apparatus for reducing cross-polarized radiation in the vicinity of the axis of a dual-polarized monopulse-type tracking antenna having four difference ports connected to respective signal channels, namely, a horizontally polarized aximuth difference first port and channel, a horizontally polarized elevation difference second port and channel, a vertically polarized azimuth difference third port and channel, and a vertically polarized elevation difference fourth port channel, wherein said apparatus comprises:

first directional coupling means, connected to the first and fourth channels, for directionally diverting a portion of a first signal in either channel to the other channel, said first directional coupling means including a first phase shifter disposed in one of the first and fourth channels and having a positive first phase shift setting, a second phase shifter disposed in the other of the first and fourth channels and having a negative first phase shift setting, a first 90 degree hybrid connected between the first and fourth channels on one side of the first and second phase shifters, and a second 90 degree hybrid connected between the first and fourth channels on an opposite side of the first and second phase shifters, whereby the first setting of the first and second phase shifters determines the magnitude of the diverted portion of the first signal relative to the magnitude of the undiverted portion of the first signal;

a third phase shifter disposed in one of the first and fourth channels on one side of the first directional coupling means and having a positive second phase shift setting;

a fourth phase shifter disposed in said one of the first and fourth channels on an opposite side of the first directional coupling means and having a negative second phase shift setting, whereby the second setting of the third and fourth phase shifters determines the phase of the diverted portion of the first signal relative to the phase of the undiverted portion of the first signal;

second directional coupling means, connected to the second and third channels, for directionally diverting a portion of a second signal in either channel to the other channel, said second directional coupling means including a fifth phase shifter disposed in one of the second and third channels and having a positive third phase shift setting, a sixth phase shifter disposed in the other of the second and third channels and having a negative third phase shift setting, a third 90 degree hybrid connected between the second and third channels on one side of the fifth and sixth,phase shifters, and a fourth 90 degree hybrid connected between the second and third channels on an opposite side of the fifth and sixth phase shifters, whereby the third setting of the fifth and sixth phase shifters determines the magnitude of the diverted portion of the second signal relative to the magnitude of the undiverted portion of the second signal;

a seventh phase shifter disposed in one of the second and third channels on one side of the second directional coupling means and having a positive fourth phase shift setting; and an eighth phase shifter disposed in said one of the second and third channels on an opposite side of the second directional coupling means and having a negative fourth phase shift setting, whereby the fourth setting of the seventh and eighth phase shifters determines the phase of the diverted portion of the second signal relative to the phase of the undiverted portion of the second signal.

8. A method for reducing cross-polarized radiation in the vicinity of the axis of a dual-polarized monopulse-type tracking antenna having four difference ports connected to respective signal channels, namely, a horizontally polarized azimuth difference first port and channel, a horizontally polarized elevation difference second port and channel, a vertically polarized azimuth difference third port and channel, and a vertically polarized elevation difference fourth port and channel, wherein said method comprises the steps of:

directionally coupling the first and fourth channels to directionally divert a portion of a first signal in either channel to the other channel;

adjusting the magnitude and phase of the diverted portion of the first signal relative to the magnitude and phase of the undiverted portion of the first signal so as to reduce the cross-polarized radiation caused by the first signal in the vicinity of the tracking antenna axis;

directionally coupling the second and third channels to directionally divert a portion of a second signal in either channel to the other channel; and adjusting the magnitude and phase of the diverted portion of the second signal relative to the magnitude and phase of the undiverted portion of the second signal so as to reduce the cross-polarized radiation caused by the second signal in the vicinity of the tracking antenna axis.

* * * * *